US006450347B1

(12) United States Patent
Hannecke

(10) Patent No.: US 6,450,347 B1
(45) Date of Patent: Sep. 17, 2002

(54) MODULAR COLUMN DISPLAY SYSTEM, ADAPTER ELEMENTS AND ANGULAR ADAPTERS FOR MERCHANDISE BOXES

(75) Inventor: Wolf-Dietrich Hannecke, Northeim (DE)

(73) Assignee: Wolf-Dietrich Hannecke Kuntstofftechnik, Northeim (DE)

( * ) Notice: Subject to any disclaimer, the term of this patent is extended or adjusted under 35 U.S.C. 154(b) by 0 days.

(21) Appl. No.: 09/341,789

(22) PCT Filed: Jan. 13, 1998

(86) PCT No.: PCT/EP98/00137

§ 371 (c)(1),
(2), (4) Date: Aug. 27, 1999

(87) PCT Pub. No.: WO98/31260

PCT Pub. Date: Jul. 23, 1998

(30) Foreign Application Priority Data

Jan. 17, 1997 (DE) ..... 197 01 257

(51) Int. Cl.[7] ..... A47B 65/00
(52) U.S. Cl. ..... 211/42; 211/107
(58) Field of Search ..... 248/218.4, 219.4; 211/42, 107

(56) References Cited

U.S. PATENT DOCUMENTS

| | | | | |
|---|---|---|---|---|
| 1,949,200 A | | 2/1934 | Freson | |
| 1,963,544 A | | 6/1934 | Burt | |
| 2,716,533 A | | 8/1955 | Freeman | |
| 2,915,194 A | | 12/1959 | Shoffner | |
| 3,176,676 A | | 4/1965 | Caldwell | |
| 3,604,369 A | | 9/1971 | Maslow | |
| 3,683,824 A | | 8/1972 | Weber | |
| 3,844,230 A | | 10/1974 | Hudson et al. | |
| 3,908,832 A | * | 9/1975 | Marshall | 211/42 |
| 4,014,437 A | | 3/1977 | Rumble et al. | |
| 4,049,330 A | | 9/1977 | Schlapp | |
| 4,336,759 A | | 6/1982 | Hannecke | |
| D266,210 S | | 9/1982 | Hannecke | |
| 4,736,856 A | | 4/1988 | Alneng et al. | |
| 4,976,359 A | | 12/1990 | Hardy | |
| 5,337,904 A | | 8/1994 | Goldberg | |
| 6,123,206 A | * | 9/2000 | Zaremba | 211/107 |

FOREIGN PATENT DOCUMENTS

| | | |
|---|---|---|
| DE | 2 206 067 | 2/1972 |
| DE | 295 06 656 | 4/1995 |
| DE | 197 01 257 | 1/1997 |
| FR | 1 248 017 | 10/1959 |
| FR | 1 444 811 | 5/1965 |
| FR | 2 127 210 | 2/1971 |
| FR | 2 282 835 | 4/1975 |
| FR | 2 718 932 | 4/1994 |
| GB | 1 079 624 | 4/1966 |
| GB | 2 027 336 | 4/1979 |

* cited by examiner

*Primary Examiner*—Ramon O. Ramirez
(74) *Attorney, Agent, or Firm*—Schmeiser, Olsen & Watts

(57) ABSTRACT

The invention relates to a modular column display system specially suitable for thin objects used to exhibit goods or pamphlets, and to adapter elements and angular adapters for merchandise boxes. The invention discloses a display system with multiple individual adjustment possibilities and whose modules are easy and economical to produce. To this end, the invention provides an adapter element (4) for a column display system (1) and angular adapters for merchandise boxes (7). The angular adapters for merchandise boxes (7) used in display systems comprise a stand segment (18) engaging in an adapter element (4) or in a supporting structure and a supporting segment (19) to fix a merchandise box, wherein the stand segment (18) has a rigidly configured hook-shaped retaining clamp (20) and at least one flexibly configured locking clamp (11). The invention also relates to angular adapters for merchandise boxes (7) to support one or more merchandise boxes and a column display system (1) comprising the inventive adapter element (4).

16 Claims, 4 Drawing Sheets

MODULAR COLUMN DISPLAY SYSTEM, ADAPTER ELEMENTS AND ANGULAR ADAPTERS FOR MERCHANDISE BOXES

FIELD OF THE INVENTION

The invention relates to a modular column display system especially suitable for thin objects, used to exhibit goods or pamphlets, and to adapter elements and angular adapters for merchandise boxes for display systems.

BACKGROUND OF THE INVENTION

Modular column display systems for merchandise or pamphlets having a plurality of merchandise boxes configured around an up-right support post are disclosed in, amongst others, DE-U 23 77 269.

Furthermore, DE 295 06 656 discloses a modular merchandise display system comprising an upright, central support post which has regularly undercut recesses, for example in the form of undercut longitudinal slots, as well as merchandise supports attached to the support post, said merchandise supports including attachment means corresponding to said recesses, said attachment means allowing said merchandise supports to be attached directly to the support post at the positions indicated by said recesses. In this case, the individual merchandise supports, which may be of random dimensions and shape, are not in the form of rack plates and can thus be anchored laterally in the recesses of the support post. Compared to the prior art display columns comprising replaceable rack plates, the disclosed display system has the great advantage that, instead of entire rack plates, its individual merchandise support modules, e.g. in the form of boxes, can be easily replaced—which makes the entire system extremely flexible and adaptable.

SUMMARY OF THE INVENTION

Furthermore, FR-A 2 718 932 describes a display stand for oblong objects, DE-U-92 17 446 relates to a copy holder, and U.S. Pat. 5,337,904 discloses a remote control support.

The prior art systems suffer from the shortcoming that only a limited number of merchandise supports can be attached around the support post. Normally, up to 6 merchandise boxes can be arranged on a common height level around the support posts usually consisting of hollow plastic tubes of a diameter of between 5 to 15 cm. In a configuration stepwise staggered in height disclosed in the abovementioned utility model specification, approx. 7 merchandise boxes can be arranged on one height level. For broad insertion compartments in the merchandise boxes, as used e.g. for displaying books, the display effect accomplished together with optimum economy of space is extremely satisfactory.

An altogether quite different situation, however, is when narrow insertion compartments for relatively thin merchandise such as newspapers, magazines, greetings cards, maps, prospectuses, packaged tights and the like are to be arranged around and attached to a support post or a rotary column, and the goods in question are to be displayed in an appropriate manner. What is of importance here no longer is keeping the dead space on and around the support post at a minimum, but rather the need to display a maximum of the goods surface, that is newspaper front pages, the pictures of postcards and the like, in a conspicuous and clearly visible manner.

A large goods surface is displayed when one-pieced rack plates of the prior art are used, in which case two insertion compartments each, defining an angle between them, have directly adjacent withdrawal openings facing radially outward, and a major number of pairs of such insertion compartments are arranged on one rack plate in what resembles the shape of a star. However, this advantage is paid for with a design which does not allow individual adaptations.

It is the object of the invention to provide a display system with multiple individual adjustment possibilities and whose modules are easy and economical to produce.

In particular, the invention is to provide a variable column display system with individually replaceable merchandise support modules which allows different configurations of merchandise supports on one height level for an optimum display of a plurality of different, and in particular thin, display objects.

According to the invention, this object is accomplished by features of claims 1, 2, 8 and 12.

By providing adapter elements and angular adapters for merchandise boxes, the invention makes it possible, without much effort, to realize a plurality of individually selectable configurations with one display system, which allows the use of support posts and merchandise boxes, which. are complex to produce, in different configurations. In this case, the adapter elements practically allow a variation of the effective support post diameter for attaching merchandise boxes. Not much technical effort is required for this purpose and the resulting weight increase is smaller for a column display system than would be the case if the support post were replaced.

Moreover, the angular adapters for merchandise boxes (for which only little production material is required), either alone or in combination with adapter elements, also contribute to broadening the scope of feasible configurations.

In a column display system, preferably at least one adapter element in the form of an adapter plate is attached to the support post, which adapter plate includes a central opening for passing the support post therethrough and has the actual merchandise boxes, or attaching means removably mounted on said merchandise boxes, in turn removably attached to its external portion.

One advantage of the invention is that the use of the adapter plate advantageously allows already existing support posts, e.g. used for arranging rack plates, to be provided with individual merchandise boxes laterally mounted thereon in a modular fashion. This also makes it possible to exploit axially rotatable support posts which are the static base element for numerous display systems, as well as pedestals or mounting units which ensure stability and, if necessary, mobility and constitute a regular high cost factor, for the purposes of the invention.

Now that there are adapter plates, rack plates which are inflexible in use and awkward to replace need no longer be used for displaying thin goods which need to be exhibited with their surfaces visible. In their stead, one and the same support post can be used advantageously for exhibiting goods of the most varied shapes, which consequently also need to be displayed differently.

For thick, large-volume goods, where the dead space around the support post needs to be minimized, one can use inventive adapter plates of appropriately small diameter—then resembling more an adapter ring, or the individual merchandise boxes can be mounted directly on the support post, by means of angular adapters for merchandise boxes, if necessary.

For problematic goods, i.e. thin and low-volume goods, which have so far required special rack plates or particularly thick support posts to be displayed in a useful and proper manner, one will choose an inventive adapter plate of appropriately larger diameter. A column display system thus equipped with different adapter plates and merchandise supports according to the invention is of uniform and appealing appearance.

The fact that the entire edge portion of each anchoring plate is available for removably attaching individual merchandise boxes thereto makes it possible to choose modes of attachment for the merchandise boxes which are by far easier to handle and more stable than is the case with modular systems of the prior art where each individual merchandise box needs to be attached directly to the scarce surface of the support post. The longer circumferential line available for attaching the merchandise supports or boxes considerably facilitates the attachment as well as any replacement of the merchandise boxes that may become necessary—which is of special advantage if numerous small merchandise boxes are to be arranged on one height level. A stable attachment, capable of withstanding loads, of individual merchandise boxes to be arranged spaced radially from the support post only becomes feasible by means of the adapter plate.

In the embodiment set out below and illustrated in the drawings, an adapter plate of circular shape is described since a circular circumference will allow the merchandise boxes to be arranged virtually without steps, thus allowing the highest possible degree of flexibility for a different configuration of merchandise boxes of different design. However, the adapter plate may also have a polygonal circumferential line.

According to one advantageous embodiment of the invention, the adapter element is provided with marks or a corresponding grid so as to facilitate or also predetermine a proper and geometrically uniform configuration of the merchandise boxes. Such a feature is of particular advantage for complex configurations involving a large number of merchandise boxes. Moreover, it is advantageous if the marks or grids are accompanied by designations which may refer to a configuration specifically intended for a certain merchandise box type or number.

A grid may for example be applied on the adapter element in the form of designated recesses or holes which will accommodate positioning pegs, noses and the like on the merchandise boxes or their attachment means.

A plurality of thin or low-volume display objects can be displayed in a well distinguishable and conspicuous fashion with simultaneous low space requirement with the merchandise boxes configured such that each merchandise box defines an angle with an adjacent merchandise box, with the withdrawal openings of the two merchandise boxes in question being next to each other and facing radially to the outside. The described configuration is particularly advantageous for effectively displaying picture postcards and greetings cards, forms and the like, that is whenever what matters is to display picture surfaces as completely as possible without a large space requirement. With the modular configuration of the invention, the advantage in this case is that merchandise boxes of different depths adapted to the respective merchandise format can also be configured in the described star-shaped pattern. This in turn makes it possible, by varying the angle defined between two adjacent merchandise boxes, to keep the total circumference of the support post to which merchandise boxes are attached uniform and regular. This is preferably accomplished by means of suitable angular adapters for merchandise boxes.

In accordance with another advantageous embodiment of the invention, the adapter elements attached to the support post can be adjusted in height, either continuously or in steps, which optimizes the economy of space and allows the different heights of various display goods to be accommodated.

Yet another advantageous embodiment of the invention relates to the design of the circumferential edge portion of the adapter element and the corresponding attachment means which may be removably mounted on the merchandise boxes and which serve to attach the merchandise boxes to the adapter plate.

If separate, removable angular adapters for merchandise boxes are used for attaching the latter—which is advantageous since the use of different types of angular adapters for merchandise boxes allows different configurations to be accomplished with the same merchandise boxes—it is especially advantageous if the attachment means include profiles into which the merchandise boxes may be slid forming a push profile. The particularly advantageous star-shaped configurations already described above may best be realized by means of angular adapters for merchandise boxes which have two profiles spaced at an angle from each other and thus being capable of receiving two merchandise boxes each. For the described applications, dove-tail profiles are especially suitable, provided with a safety latch, thus forming a stable and at the same time easily removable connection of attachment means and merchandise box.

If the adapter plate has reinforcement means on its circumferential edge, then this will result in considerable weight and material savings on the one hand, at the same time maintaining the stability of the adapter plate. On the other hand, such reinforcement means may advantageously be used for removable connections with the special attachment means, in which case the attachment means include gripper extensions which snap or clip on the reinforced edge. The reinforced edge has shown to increase stability advantageously, and to be suited for clipping or snapping the attachment means onto it if it is in the form of a wall substantially perpendicular to the adapter plate surface, at the upper edge of which the attachment means may be hung and anchored in place by means of one or plural clamps at the bottom edge. If necessary, an edge reinforcement of this type may be stabilized by means of webs or ribs provided between the adapter plate surface and the reinforcement wall.

Angular adapters for merchandise boxes are particularly suitable for use in column display systems, in combination with adapter elements. However, they may just as well be used in other support systems, e.g. with flat wall elements or oblong, if necessary also flat wall rails.

As already discussed in detail, the display system of the invention is particularly suitable for exhibiting thin and low-volume objects. Many such objects are inherently not very rigid, hence they are only to some extent fit for an upright display position. A solution to this problem is the use of merchandise boxes equipped with clamping means holding the objects, single sheets, folded maps, thin magazines and the like to be received therein in an upright position.

The weight and the production costs of a modular display system according to the invention may advantageously be kept low if the support post, the adapter elements, if necessary the angular adapters for the merchandise boxes and the merchandise boxes themselves are made of plastic, with transparent plastics being particularly preferred for the merchandise boxes. For manufacturing the three latter components, the prior art plastic injection molding processes are especially suitable.

As a final point and for the sake of completeness, it should be noted that the inventive display system is preferably provided with an axially rotatable support post which may be mounted on a stand pedestal, like the prior art rotary columns, on a running gear on wheels or may be anchored stationary in the ground.

BRIEF DESCRIPTION OF THE DRAWINGS

The invention is set out in more detail hereinafter with reference to an embodiment illustrated in the drawings which is particularly preferred for exhibiting low-volume or thin objects. In the drawings.

DETAILED DESCRIPTION OF THE INVENTION

Figure 1:
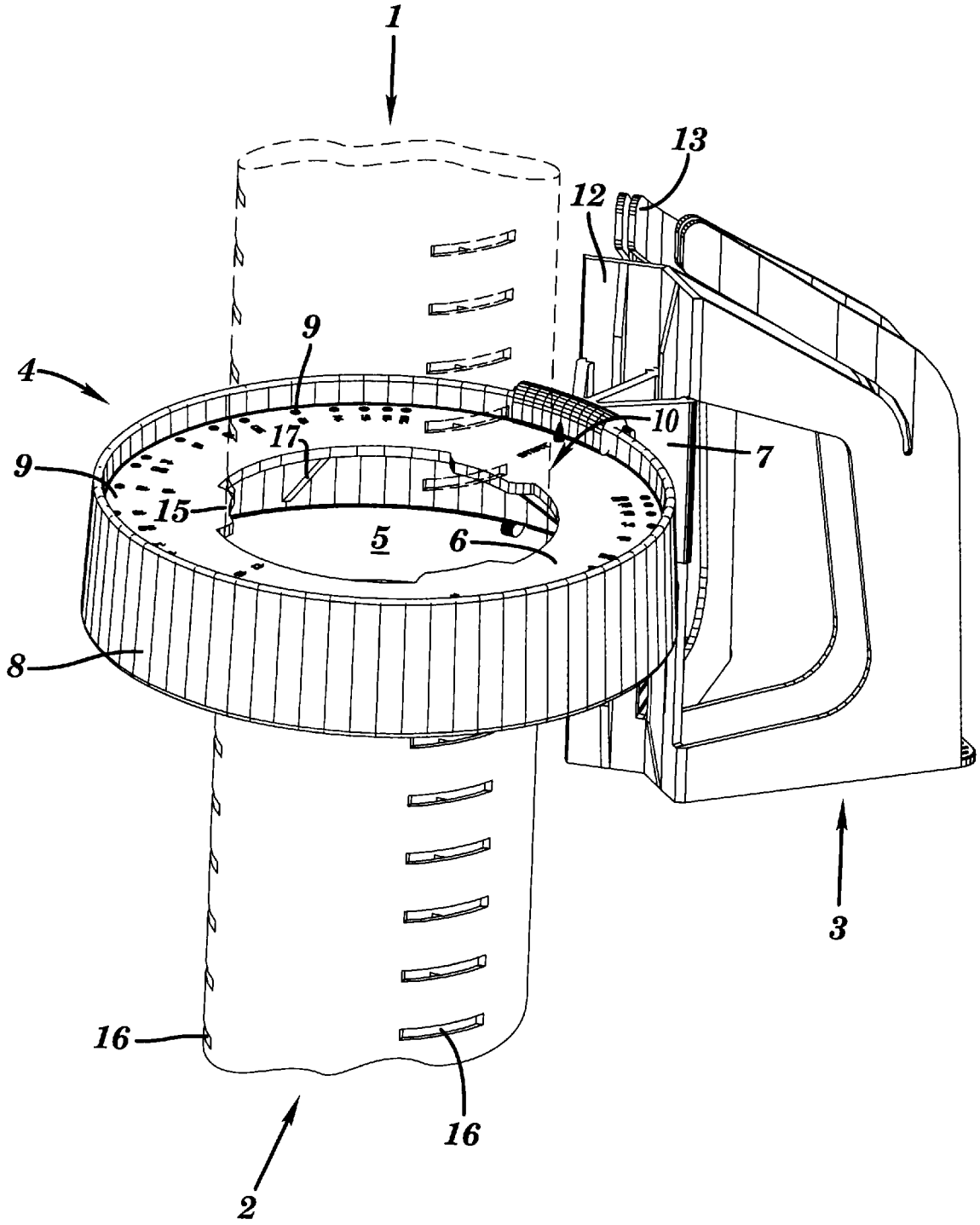
FIG. 1 shows a perspective partial view of a column display system according to a preferred embodiment of the invention.

The column display system 1 shown in perspective partial view in FIG. 1 includes a support post 2 made of a hollow plastic profile tube, of which only the upper part is roughly outlined by means of dashed lines. Said support post 1 extends through the central opening 5 of an adapter element in the form of an adapter plate 4. Said adapter plate 4 is fixed in height by means of three nose projections 15 functioning as coupling elements located on the edge of the circular opening 5 and extending radially inward. Said projections 15 engage in respective milled grooves 16 of which there are three each at every height level of the support post 1. Over the entire length of the support post 1 three milled grooves 16 each which are parallel in height are spaced at regular intervals from each other, thus allowing each adapter plate 4 to be adjusted in height in steps corresponding to the grid.

Adjoining its annular support structure 6, the adapter plate 4 shown includes an edge reinforcement 8 in the form of an upright wall on and around its circumferential edge. Said edge reinforcement 8 is in the form of a receiving section for merchandise boxes and angular adaptors for merchandise boxes. Extending between the downward facing part of the edge reinforcement 8 and the surface part of the adapter plate 4 are ribs 17 lending the adapter plate 4 the required degree of stability even if the latter is exposed to heavy loads.

Figure 6:
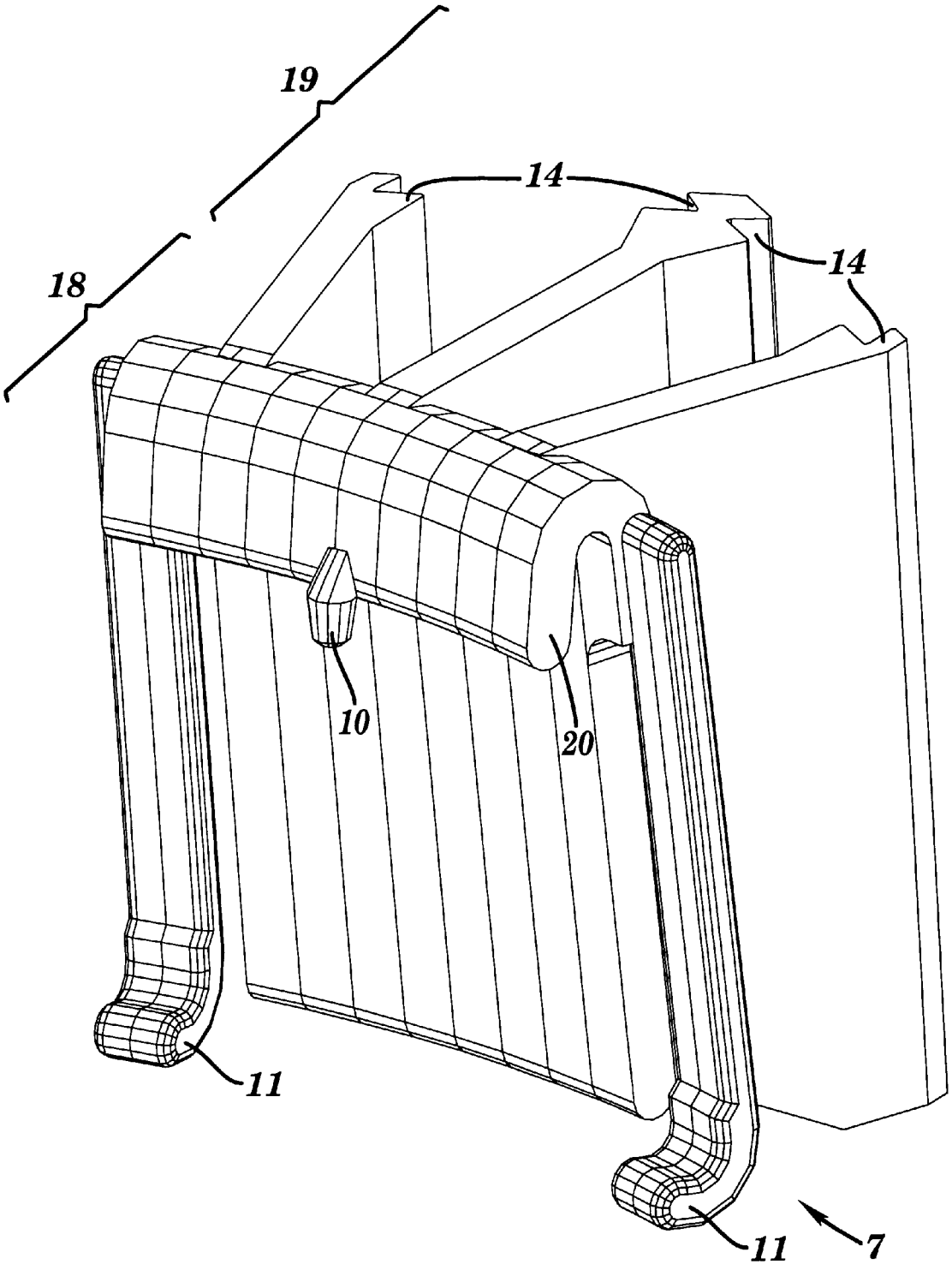
FIG. 6 shows a perspective view of a preferred embodiment of an angular adapter for merchandise boxes for removably connecting merchandise boxes to the adapter plate according to the invention.
Figure 1:
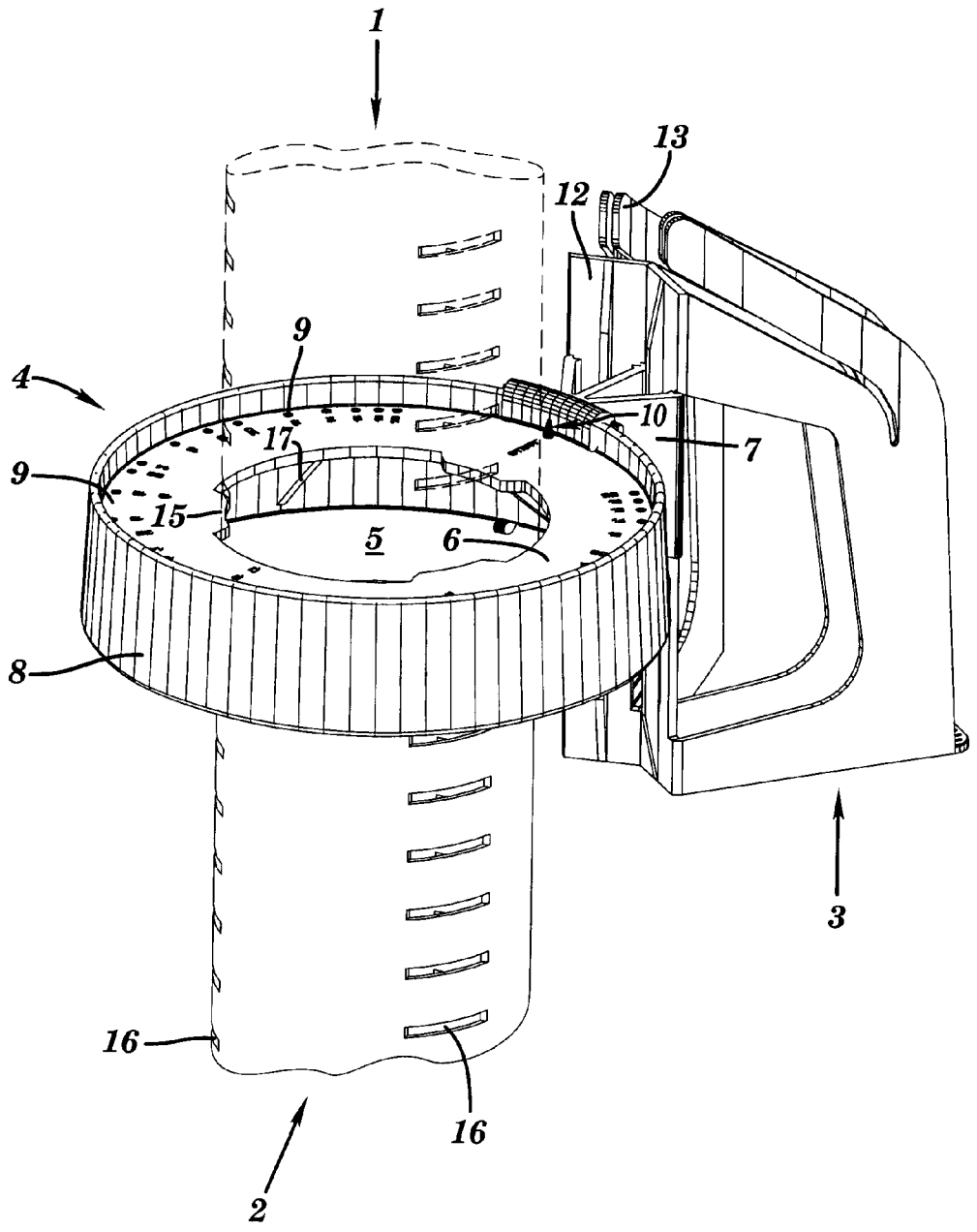

As shown in FIG. 1, an angular adapter 7 for merchandise boxes is removably snapped onto the wall-like edge reinforcement 8. This snap-on connection is obtained by first of all hooking the stand segment 18 of the angular adapter 7 for merchandise boxes (shown alone in FIG. 6) onto the upper edge of the edge reinforcement 8 at a relevant position and then snapping-on the bottom clamps 11 (locking clamps) at the bottom edge of the edge reinforcement 8 by applying a slight downward and inward-directed pressure. For removing the attachment means 7 at a later time, one has to proceed by analogy, in the reverse order of steps. The illustrated snap-on connection has the major advantage that, on the one hand, it can be attached and detached without any tools, and that it can easily withstand the high vertically downward-directed forces resulting from the loading of the merchandise boxes 3.

The individual merchandise boxes 3 are inserted in the reception profile 14 of a merchandise box supporting segment 19 of each angular adapter 7 for merchandise boxes, thus forming a dovetail profile 12, said angular adapter 7 for merchandise boxes including two reception profiles 14 arranged to define an angle between them. This results in the particularly advantageous configuration of the merchandise boxes 3, the top view of which resembles a star in shape. In this case, each merchandise box 3*a* may be allocated an adjacent merchandise box 3*b* with which it forms an angle, with the withdrawal openings of the two relevant merchandise boxes (3*a*, 3*b*) being adjacent and facing radially outward. The top view of the adapter plate 4 which, for the sake of clarity, has not been loaded entirely with merchandise boxes 3 is shown in FIG. 2.

Figure 2:
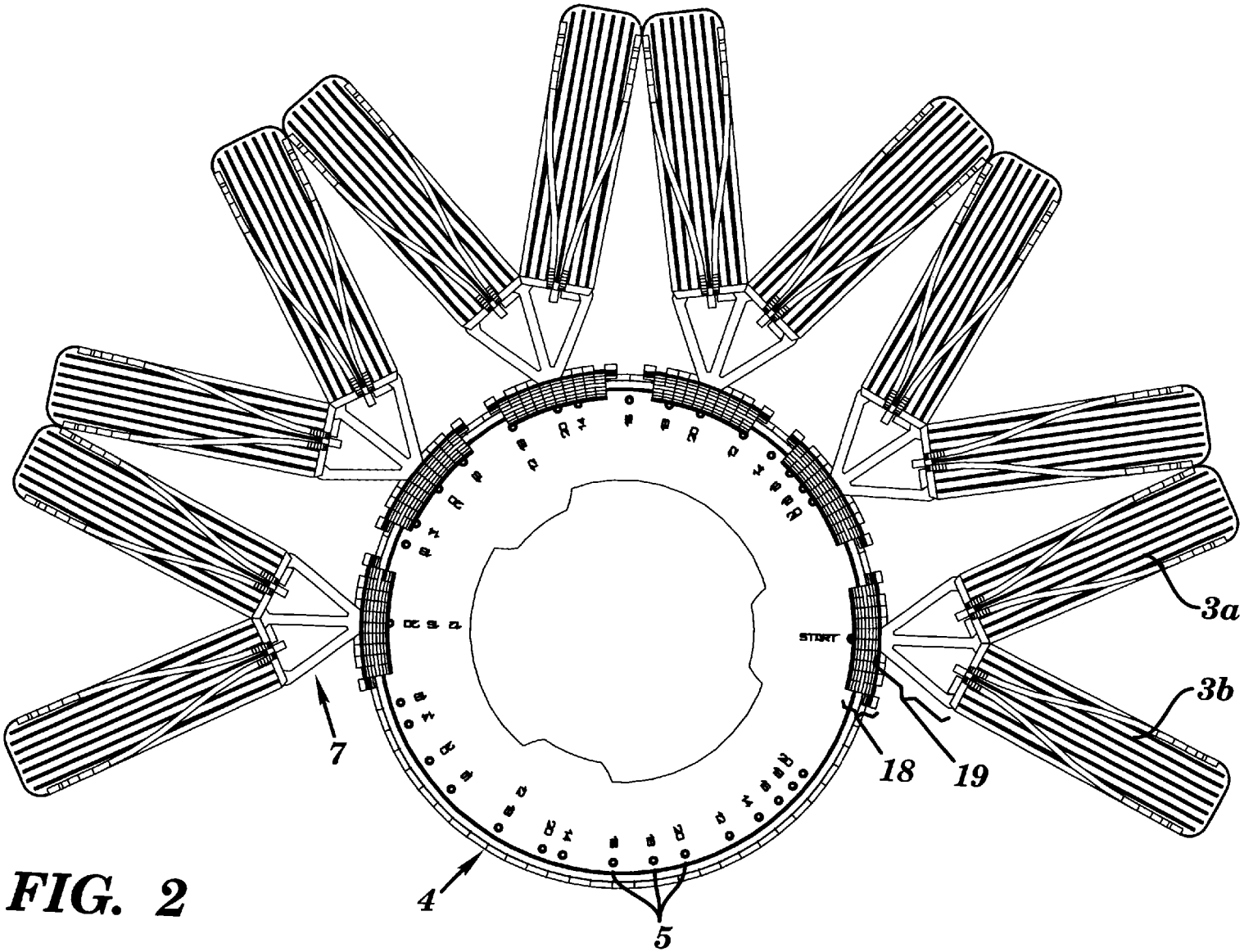
FIG. 2 shows a top view of an adapter element in the form of an adapter plate with merchandise boxes arranged in star-shape according to a preferred embodiment of the invention.

The adapter plate 4 shown in FIGS. 1 and 2 furthermore includes a grid predetermining the specific configuration of the merchandise boxes 3. Said grid comprises a number of recesses or apertures 9 positioned all around the adapter plate 4 and being designated appropriately. Said recesses or apertures serve to accommodate positioning pegs or noses 10, of which there is one each on every Angular adapter 7 for merchandise boxes. If exclusively merchandise boxes 3 of identical dimensions are to be used, as is the case in the described embodiment for ease of illustration, totally different configurations can be obtained by merely exchanging the angular adapters 7 for merchandise boxes. Three different such configurations are schematically shown as examples in FIGS. 3 to 5. The designations of the apertures or recesses 9 indicate at which exact position the respective angular adapters 7 for merchandise boxes have to be snapped on so as to obtain the appropriate spatial configuration for the respective angular adapter 7 for merchandise boxes and the box 3 attached thereto.

Figure 5:
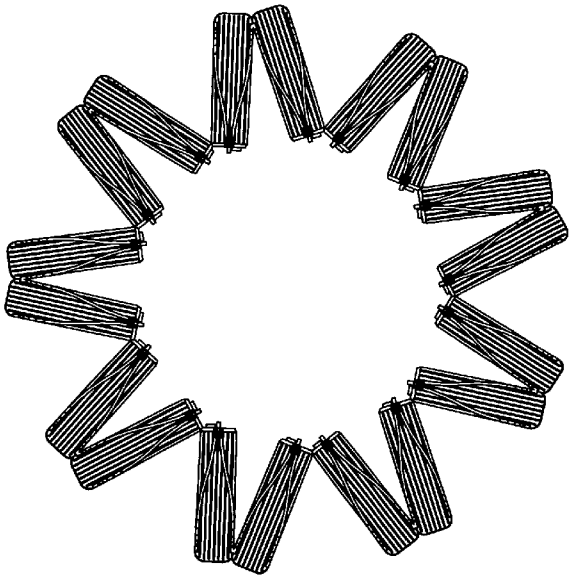
FIGS. 3, 4, 5 each show a schematical view of different configurations of merchandise boxes on an adapter plate (not shown)
Figure 4:
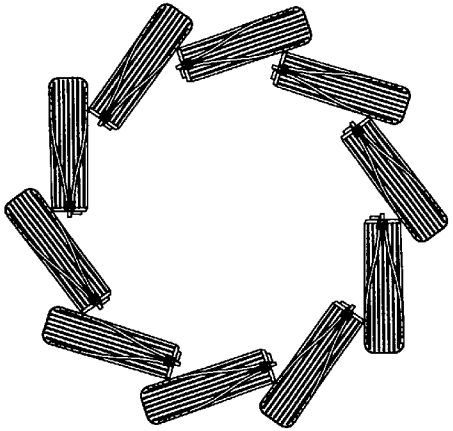
Figure 3:
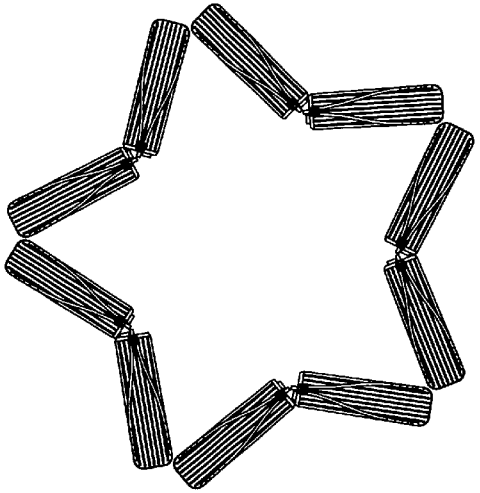

FIGS. 3 to 5 not only illustrate that different display requirements may be accommodated in a simple manner by merely exchanging the angular adapters 7 for the merchandise boxes—e.g. a change-over from a star-shaped configuration as shown in FIG. 3 to an overlapping configuration as shown in FIG. 4 where not explicitly shown angular adapters for merchandise boxes are used to which only one merchandise box 3 each is attached. Furthermore, from a comparison of the configurations of FIG. 3 or FIG. 4 with that of FIG. 5, it is clear how the capacity of a display system according to the invention may be varied, if necessary, by means of simple measures. In the embodiment shown, the capacity is almost doubled by increasing the number of merchandise boxes 1.8 times.

It is to be noted that the embodiments shown are nothing but exemplary illustrations of few variants of the invention, all the more so since the variants shown in FIGS. 3 to 5 merely involve an exchange of the angular adapters 7 for merchandise boxes. Much more variation options of the modular system according to the invention may be obtained by additionally using merchandise boxes 3 of different designs as well as adapter plates 4 of different diameters.

The chosen embodiment shows a merchandise box 3 which is particularly suitable for thin, display objects of low rigidity, due to its shape and its clamping means 13 in the form of two clamping elements 13*a*, 13*b*. The advantage of the clamping means 13 illustrated is that it is an integral part of the one-pieced injection molded merchandise box, with the curved portion of the clamping elements 13*a*, 13*b* being the result of a selective thermal shaping process carried out on the original injection molded part.

What is claimed is:

1. A modular column display system used to exhibit merchandise or pamphlets, especially thin objects, including a substantially upright support post as well as a plurality of merchandise boxes characterized by an adapter element with a support structure for at least partially encompassing said support post of said column display system, with coupling elements mounted or formed on said support structure for engaging said support post, and a reception section for receiving, in an arrangement virtually without steps, angular adapters for said merchandise boxes, on which said merchandise boxes can be mounted, and at least one angular adapter receiving at least one of said merchandise boxes.

2. The modular column display system as claimed in claim 1 characterized in that the adapter elements are mounted on said support post such that they can be adjusted in height.

3. The modular column display system as claimed in claim 1 characterized in that the support post, the adapter elements, the merchandise boxes are made of plastic.

4. An adapter element for a column display system including a support structure for at least partially encompassing a support post of said column display system, with coupling elements mounted or formed on said support structure for engaging said support post and with a reception section for receiving, in an arrangement virtually without steps, angular adapters of said merchandise boxes on which angular adapters for said merchandise boxes can be mounted.

5. The adapter element as claimed in claim 4 characterized in that marks or grids facilitating or predetermining the configuration of said merchandise boxes or the angular adapters for said merchandise boxes are provided.

6. The adapter element as claimed in claim 4 characterized in that said support structure is a ring structure or a plate with an essentially circular inner opening for receiving said support post therein, said ring structure or the plate having a substantially cylindrical, circular circumference.

7. The adapter element as claimed in claim 4 characterized in that the reception section for the merchandise boxes, or the angular adapters for said merchandise boxes, includes an edge reinforcement onto which the merchandise boxes or the angular adapters for said merchandise boxes may be snapped.

8. The adapter element as claimed in claim 7 characterized in that the edge reinforcement in the form of a wall which extends substantially perpendicular to the plane of the adapter element, and wherein said merchandise boxes, or said angular adapters for said merchandise boxes, can be hooked onto the upper edge of said wall and clamped or snapped into position at its lower edge.

9. The modular column display system as claimed in claim 1 characterized in that at least one angular adapter is provided for engaging said adapter element and at least one merchandise box supporting segment to fix at least one of said merchandise box, said angular adapter further including a stand segment, wherein said stand segment has a rigidly configured hook-shaped retaining clamp and at least one flexibly configured locking clamp.

10. The modular column display system as claimed in claim 9 characterized in that the stand segment of the angular adapter is slightly convex in shape so as to make the angular adapter for said merchandise boxes attachable to structures of different curvature.

11. The modular column display system as claimed in claim 9, characterized in that the angular adapter comprises at least two reception profiles for said merchandise boxes that are provided in the merchandise box supporting segment, said reception profiles holding said merchandise boxes in a kind of fanned position in which they define an angle between them.

12. The modular column display system as claimed in claim 11 characterized in that the merchandise box supporting segments include one or two profiles spaced so as to define an angle between them into which said merchandise boxes may be inserted to form a push profile.

13. The modular column display system as claimed in claim 12 characterized in that the angular adapter is provided with dovetail profiles.

14. The modular column display system as claimed in claim 12 characterized in that the angular adapter is provided with a safety latch.

15. The adapter element of claim 5 characterized in that the grid consists of recesses or apertures in which protrusions of the angular adapters for said merchandise boxes intended for this purpose engage.

16. The modular column display system as claimed in claim 9 characterized in that the stand segment of the angular adapter is intended for hooking onto an edge reinforcement having a wall-like structure, with the rigidly configured hook-shaped retaining clamp being centrally disposed and two locking clamps being laterally offset therefrom in the direction of the wall.

* * * * *

UNITED STATES PATENT AND TRADEMARK OFFICE

CERTIFICATE OF CORRECTION

PATENT NO. : 6,450,347 B1
DATED : September 17, 2002
INVENTOR(S) : Hannecke

It is certified that error appears in the above-identified patent and that said Letters Patent is hereby corrected as shown below:

Drawings,
Please delete page 1 of the Drawings and replace with the enclosed page 1, to reflect correction to reference numeral 10.

Signed and Sealed this

Eleventh Day of February, 2003

JAMES E. ROGAN
*Director of the United States Patent and Trademark Office*